US006637442B1

(12) United States Patent
Evans et al.

(10) Patent No.: US 6,637,442 B1
(45) Date of Patent: Oct. 28, 2003

(54) APPARATUS AND METHOD FOR CLEANING HOPPER BARGES

(76) Inventors: Jeffrey Clifton Evans, 1812 Verdun Dr., La Place, LA (US) 70068; Daniel Leo Trepagnier, 1716 Bayonne Dr., La Place, LA (US) 70068; Robert M. Zone, Jr., 5200 Senac Dr., Metairie, LA (US) 70003

( * ) Notice: Subject to any disclaimer, the term of this patent is extended or adjusted under 35 U.S.C. 154(b) by 0 days.

(21) Appl. No.: 09/501,750

(22) Filed: Feb. 10, 2000

Related U.S. Application Data

(60) Provisional application No. 60/147,074, filed on Aug. 4, 1999.

(51) Int. Cl.[7] ..... B08B 9/08

(52) U.S. Cl. ..... 134/22.1; 134/34; 134/166 R; 134/169 R; 134/172; 134/167 R; 15/302; 15/320

(58) Field of Search ..... 134/94.1, 95.3, 134/98.1, 99.1, 103.1, 166 R, 167 R, 168 R, 172, 169 R, 198, 22.1, 22.18, 34, 42; 15/302, 314, 320, 321

(56) References Cited

U.S. PATENT DOCUMENTS 3,182,669 A 5/1965 Campbell et al.
3,461,889 A 8/1969 Saxonmeyer
3,477,178 A 11/1969 Hulbert (List continued on next page.)

OTHER PUBLICATIONS

Jeffrey Clifton Davis, Confidential Disclosure to Inventor's Employer, Nov. 8, 1994, 6 pages (unpublished).

Affidavit of Inventor Attesting to Circumstances of Disclosure, Feb. 7, 2000, 2 pages (unpublished).

*Primary Examiner*—Frankie L. Stinson
(74) *Attorney, Agent, or Firm*—Adams and Reese, LLP

(57) ABSTRACT

An apparatus for cleaning holds of dirty hopper barges, the apparatus configured for use on a disposal hopper barge floating on a water body, the disposal hopper barge having a substantially lengthwise opening communicating with a hold of the disposal hopper barge and a rolling platform mounted over the lengthwise opening and translatable fore and aft along the lengthwise opening, comprising a cleaning plant mounted on the rolling platform such that translation of the rolling platform along the lengthwise opening permits the cleaning plant to be selectively positioned along the lengthwise opening. The cleaning plant is preferably provided with a vacuum system means for use in vacuum transfer of waste from the holds of the dirty hopper barges to the hold of the disposal hopper barge, an immersion pump system for removing separated water from the hold of the disposal barge, a pressurized water system means on the cleaning plant for washing down the holds of the dirty hopper barges, maintenance tools and equipment, and a means for moving the plant fore and aft along the lengthwise opening. A pair of such rolling platforms and cleaning plants may be provided, to thereby permit independent operation on either side of the disposal hopper barge. Methods of using the cleaning plant are also provided.

36 Claims, 7 Drawing Sheets

U.S. PATENT DOCUMENTS 3,595,405 A * 7/1971 Kleunen
3,625,234 A * 12/1971 Baldwin
3,651,943 A * 3/1972 Di Perna
3,727,766 A * 4/1973 Horne et al.
3,746,023 A * 7/1973 Smith
3,756,375 A * 9/1973 Briggs
3,951,092 A 4/1976 Van Den Broek
3,966,615 A * 6/1976 Petchul
3,973,512 A * 8/1976 Fahrner
3,974,940 A * 8/1976 Bartik
3,984,944 A 10/1976 Maasberg et al.
3,989,070 A * 11/1976 Liberg
3,990,748 A * 11/1976 Ghusn et al.
4,018,683 A * 4/1977 Walters et al.
4,163,455 A 8/1979 Hebert et al.
4,220,170 A 9/1980 Hebert et al.
4,362,628 A 12/1982 Kennedy et al.
4,462,328 A * 7/1984 Oram
4,530,131 A * 7/1985 Zell et al.
4,587,985 A * 5/1986 Flanagan
4,592,786 A * 6/1986 Williams et al.
4,623,452 A * 11/1986 Petersen
4,671,725 A * 6/1987 Evans et al.
4,716,917 A * 1/1988 Schmidt
5,041,165 A * 8/1991 Urbani
5,045,217 A * 9/1991 Roman et al.
5,048,445 A * 9/1991 Leber et al.
5,273,591 A * 12/1993 Perkins
5,331,911 A * 7/1994 Bost et al.
5,398,632 A 3/1995 Goldbach et al.
5,409,025 A 4/1995 Semler et al.
5,479,869 A * 1/1996 Coudon et al.
5,908,040 A 6/1999 Defraites, Jr.
6,148,921 A * 11/2000 Valla et al.

* cited by examiner

APPARATUS AND METHOD FOR CLEANING HOPPER BARGES

CROSS REFERENCES TO RELATED APPLICATIONS

Applicants herein claim priority to U.S. Provisional Patent Application Ser. No. 60/147,074, which was filed in the United States Patent and Trademark Office on Aug. 4, 1999.

FIELD OF THE INVENTION

The present invention relates to an apparatus and methods for cleaning hopper barges, and more particularly to apparatus and methods for more efficiently cleaning and transferring residual solid particulate from hopper barges following unloading. The invention addresses deficiencies of existing hopper barge cleaning protocols, including particularly the difficulty and time required to access and clean a large array of hopper barges when gathered on a river or other water way, as well as environmentally correct means of disposing of water used in the cleaning process. The present invention also relates to an apparatus and method for reclaiming coal from coal barges following offload in a more efficient and environmentally friendly procedure.

BACKGROUND OF THE INVENTION

The inside hull of river and other convention hopper barges comprises a large hold that can be filled with dry bulk particulate material, such as grains, cement powder, and coal, for transport. Hopper barges are also filled with larger solids such as coal, and with solid/water slurries. After material has been unloaded from the hold, the hold typically requires cleaning to remove residual particulate material, coal, or slurry, particularly if the hold is to be filled with a different type of material. The cleaning process is labor intensive, as will be described.

When a fleet of so-called "dirty" barges must be cleaned, the existing method most typically employed requires each barge, or a small group of barges, to be motored (e.g. tugboat) to a centralized cleaning station or site. Current methods of removing residual, solid particulate from solid cargo hopper barges during post-offload cleaning employ portable vacuum machines (including on floating platforms), mechanized collection (e.g., small front-end loaders placed in hold; crane barge offloading) and/or manual disposal (e.g., sweeping and shoveling) of the material at a dock facility or into an adjacent hopper barge. As a fleet of barges is cleaned, the equipment must be moved manually and/or crane lifted from barge to barge. Another method uses a dock-based central cleaning plant, which requires that each barge be motored, such as by tugboat, to the cleaning plant, which can be expensive.

There is thus a need for an apparatus and methods that can be delivered to a fleet, individual, or array of dirty hopper barges and used to efficiently clean said fleet or array of dirty hopper barges.

OBJECTS AND SUMMARY OF THE INVENTION

It is an object of the invention to provide a cleaning plant for cleaning dirty hopper barges that is mounted on a rolling platform, thereby facilitating use of the entire length of the hold of the disposal hopper barge for disposal of waste.

It is another object of the invention to provide a cleaning plant for cleaning dirty hopper barges that provides for both vacuum and pressurized water cleaning of the dirty hopper barges.

It is another object of the invention to greatly improve the efficiency of the process of cleaning dirty hopper barges by enabling an array of dirty barges to be cleaned at one time with minimum movement of the dirty barges.

It is yet another object of the invention to provide methods of using the cleaning plant to clean holds of dirty hopper barges.

These and other objects and advantages of the invention shall become apparent from the following general and preferred description of the invention.

Accordingly, the present invention consists of an apparatus and methods for cleaning hopper-type cargo barges employed in the transport of solid particulate and low viscosity liquids following cargo offload and as preparation for their return to service. To expedite the process of cleaning and returning to service large fleets of hopper barges, a floating cleaning and maintenance plant is described that can be easily moved among, and simultaneously clean multiple hopper barges. The floating cleaning vessel can be readily adapted from a conventional, solid cargo hopper barge by installation of the plant on a rolling platform. The rolling platform can be adapted from an existing roll cover. By use of a rolling platform, the plant can be moved along the length of the vessel, rolling along the standard roll cover track, expanding its range of operation. Movement of the wheeled roller cover is provided by mechanical assistance, either by cable and winch or other means (e.g., direct drive). In addition to existing roller covers, which are widely available but typically require reinforcement, other steel skids can be designed for this application. In addition to providing a platform for the plant, the cleaning vessel provides an empty hold to collect residual solid particulate during the cleaning operation.

The apparatus described in the present invention consists of a vacuum cleaning and pressurized water generating plant which can be mounted on an empty hopper-type cargo barge, the collective assembly serving as a floating cleaning plant that can easily access and clean single or multiple hopper barges at almost any location on a waterway. The plant consists of a vacuum system, pressurized water system and maintenance equipment including welding supplies. The plant provides systems to vacuum transfer solid particulate or water-dispersed slurries of particulate from the holds of the "dirty" barges to the empty hold of the cleaning vessel, pressurized water for washing down the holds of the "dirty" barges and pressurized water to drive siphon-type vacuum pumps that can be used to remove and discharge small quantities of materials into the river (e.g., environmentally acceptable materials such as grains) or an adjacent collection point.

The floating cleaning plant can be easily positioned among, and clean, multiple hopper-type cargo barges at their existing mooring or location on a waterway. This method eliminates the typical time and manpower-consuming method of individually moving single barges to a fixed, land-based cleaning station. Once positioned among multiple barges the cleaning plant is designed to be mechanically moved along the length of the vessel (i.e., from bow to stern) to permit it to sequentially service, via placement of the vacuum and pressurized water hoses provided by the plant, into the holds of an array of assembled "dirty" barges. This method permits the simultaneous servicing of multiple barges and reduces the number of times a fleet of "dirty" barges must be moved during the cleaning process.

The cleaning plant provides two methods of vacuum removal of residual solids from cargo barges: (1) a vacuum pump with large bore (e.g., 8 inch diameter) flexible hoses for extracting coal and other larger size solids and solid/water slurries, and (2) a pressurized water-driven syphon pump that can be used to extract finer size particulate solids such as grains. The stationary vacuum system, however, provides greater vacuum power enabling it to evacuate large solids (e.g., coal) and slurries to the cleaning vessel. While the stationary vacuum method is ideally suited to cleaning hopper barges immediately adjacent to the cleaning vessel, such as coal barges, the water-driven siphon method can be used to service barges assembled a longer distance from the plant as would be the case when servicing a group of barges assembled in parallel with the cleaning vessel. Thus, an advantage of the water-driven siphon vacuum system is its ability to project a vacuum source a significantly greater distance from the cleaning vessel than the fixed vacuum system, thus expanding the plant's effective operating range significantly.

The vacuum system is typically installed with two or more vacuum hoses to allow simultaneous vacuum cleaning of multiple barges. Solid particulate or water-dispersed solid particulate drawn into the plant is ejected vertically downwards through a chute into the hold of the barge to which the skid-mounted plant is installed on. Discharge of water that collects in the hold is provided by positive-displacement pumps located, in a typical example, at the bow and stern of the vessel.

Means are provided in the present invention to eliminate water in the hold, typically collected during vacuum cleaning of solid/water slurries, by overboard disposal via immersion pumps installed in the vessel hold. Suction piping with inlet filters is installed in the hold with discharge directed overboard through flexible hose or fixed pipe. This extends the capacity of the hold and use of the cleaning vessel, as well as reduces the weight of the contents that must eventually be disposed. Once the hold is full the vessel can be offloaded by conventional means or the plant can be removed and installed on an empty hopper barge of similar size. Pad eyes are mounted along the periphery of the skid which enable it to be crane lifted and re-located onto another vessel.

The pressurized water system of the cleaning and utility plant consists of one or more water pumps that draw water from the river or waterway in which the vessel resides. Single or multiple flexible rubber or plastic hoses (e.g., 2–4 inch diameter) can be attached to manifolds to direct pressurized water for cleaning the "dirty" cargo barges, such as directing and collecting solid particulate into one area of a hold for vacuum extraction.

The cleaning and utility plant also contains welding and other repair equipment that can used to make quick repairs of the cargo barges while they are undergoing cleaning or on other occasions.

A pair of such rolling platforms and cleaning plants may be provided, to thereby permit independent operation on either side of the disposal hopper barge.

The present invention greatly improves the efficiency of the cleaning process by enabling an array of barges to be cleaned at one time with minimum movement of the fleet barges. Specifically, the cleaning vessel of the present invention, with a multiplicity of vacuum sources and pressurized water outlets, can gain access to multiple vessels at one time. By providing access to a vacuum and pressurized water source at multiple locations an array of vessels can be assembled about the hopper barge at one time significantly reducing the frequency with which "dirty" barges must be re-positioned during the cleaning of multiple vessels. This in turn reduces the time, man-power requirements and fuel consumption of the cleaning process.

The cleaning vessel of the present invention also provides means of collecting, and reclaiming a large quantity of residual coal from coal barges. Residual coal from the holds of numerous coal barges can be vacuum collected as water slurries into the hold of the cleaning vessel. The present invention provides a means to increase the volume of coal in the hold by disposing of the collected water, once the water separates from the coal, by filtering and pumping it overboard.

DESCRIPTION OF PREFERRED EMBODIMENTS OF THE INVENTION

Figure 1:
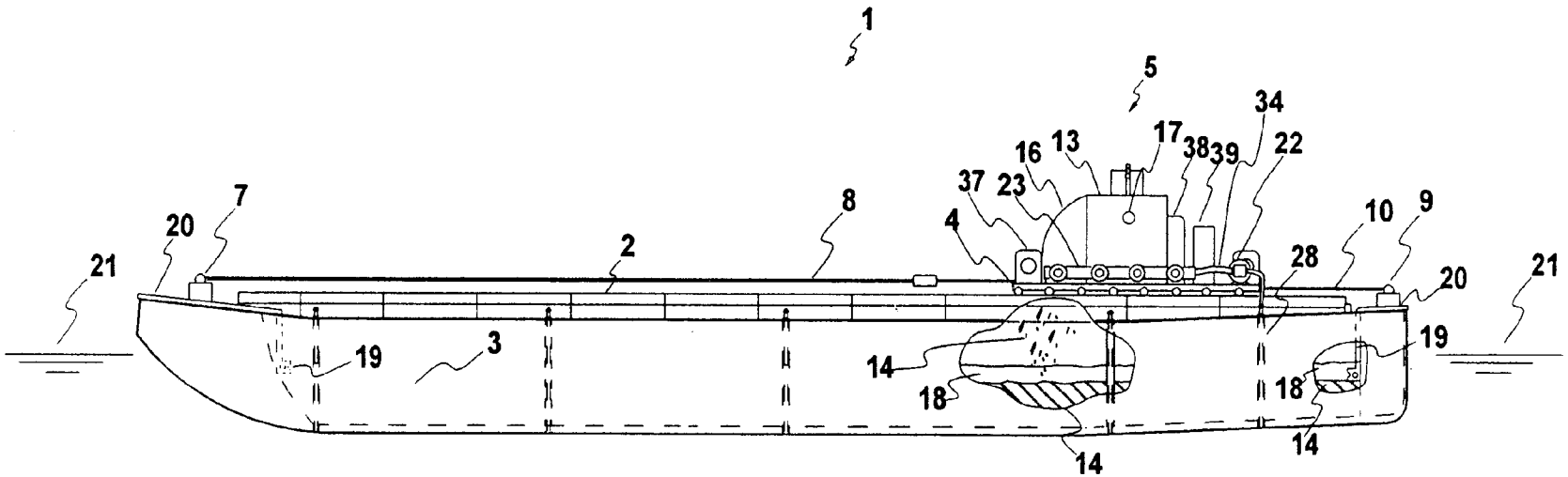
FIG. 1 is a side elevation of a preferred embodiment of the present invention describing the cleaning vessel and roller cover mounted cleaning and utility plant.
Figure 2:
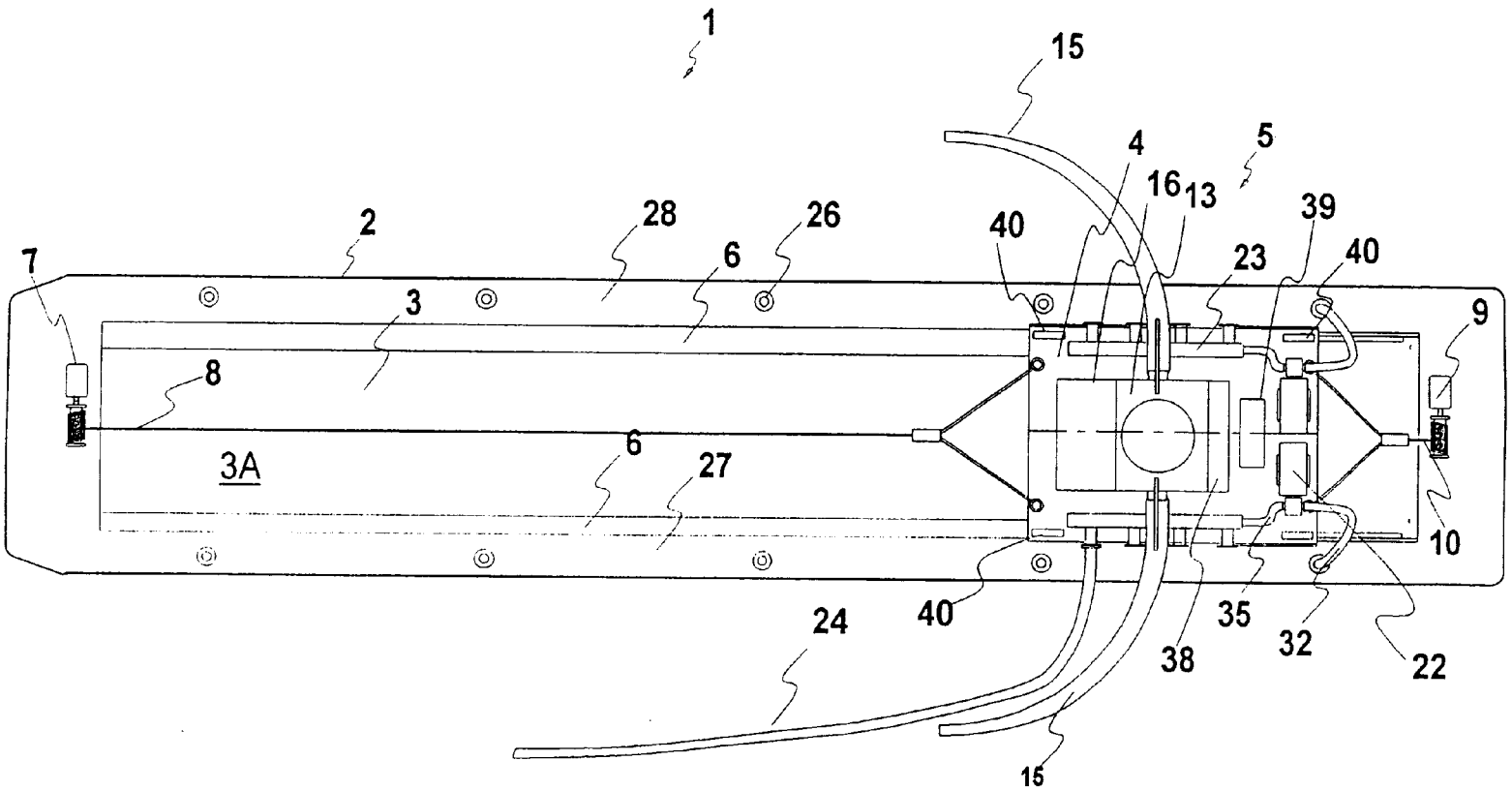
FIG. 2 is a plan view of a preferred embodiment of the present invention describing the cleaning vessel and roller cover-mounted cleaning and utility plant.
Figure 3:
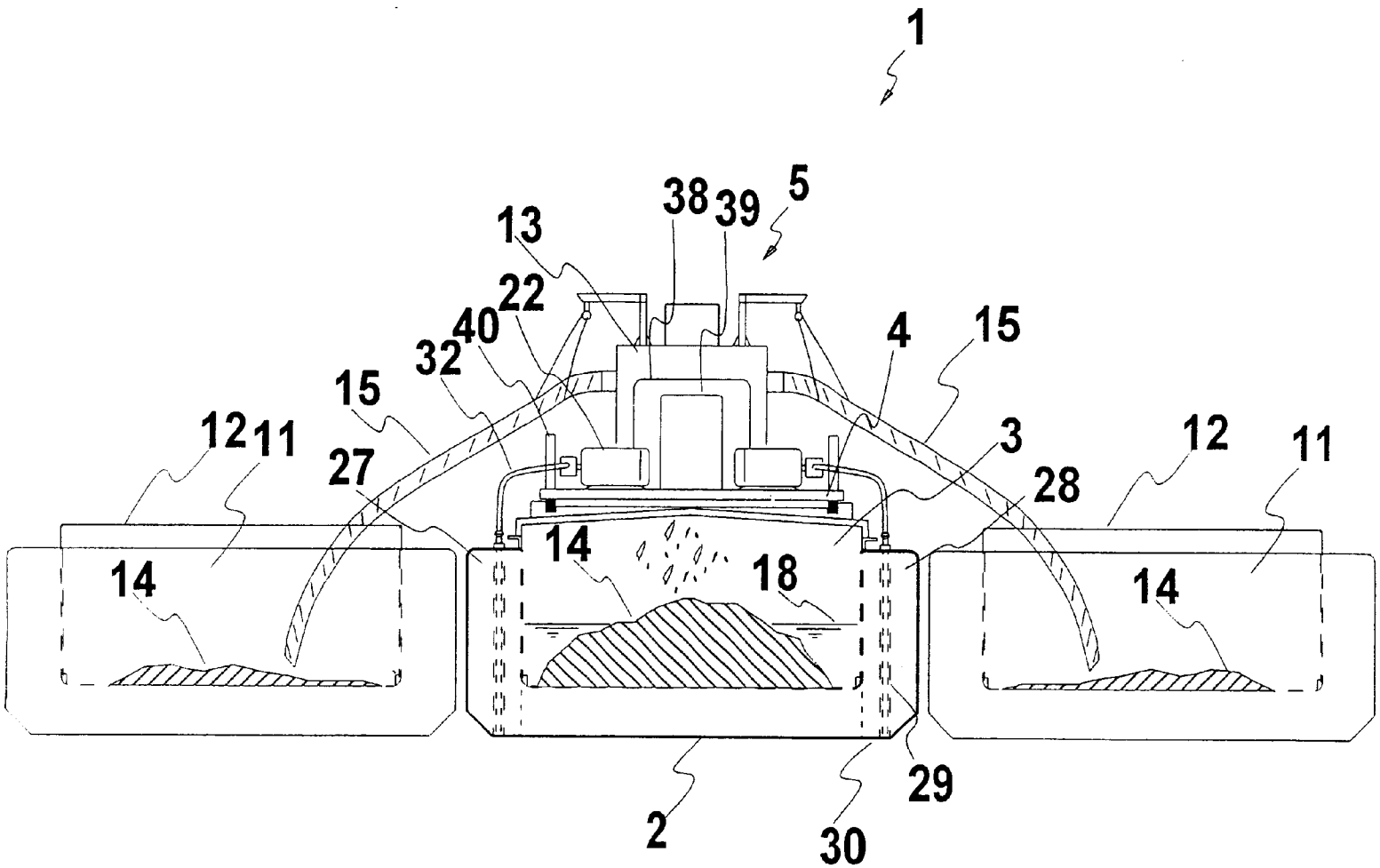
FIG. 3 is a cross-sectional view of a preferred embodiment of the present invention describing the cleaning vessel, roller cover-mounted cleaning and utility plant and hopper barges in a typical orientation during cleaning.

Turning now to the drawings and referring initially to FIGS. 1, 2 and 3, there is illustrated an apparatus 1 for cleaning hopper-type cargo barges 12 employed in the transport of solid material on rivers and inland waterways. The apparatus 1 consists, generally, of a conventional hopper barge 2, a deck of the hopper barge 2 having a lengthwise opening 3A communicating with cargo hold 3 of the barge 2, a rolling platform 4 or equivalent supporting surface mounted over the cargo hold 3, and a cleaning and maintenance plant 5 mounted on the rolling platform 4. The rolling platform 4 may be a conventional steel roll cover 4, in which case the steel roll cover 4 is preferably structurally reinforced. The rolling platform 4 can also be configured from a steel plate or other structurally firm foundation mounted on wheels or the like. The rolling platform 4 is preferably provided with a safety brake means, such as pins on the rolling platform 4 that slide into holes in wheel track 6. Due to the heavy weight of the rolling platform 4 and the cleaning and maintenance plant 5, the wheels of the rolling platform 4 are preferably non-compressable. The wheels may be configured in the manner of conventional steel railroad car wheels.

The rolling platform 4 and attached cleaning and maintenance plant 5 can translate substantially the length of the vessel 2, i.e., from bow to stern, by rolling along the wheel tracks 6 typically installed on hopper-type barges. The tracks 6 can be configured in any of a number of ways, such as a railroad-type rail for supporting and engaging wheels of the rolling platform 4, a double barrier along either side of the wheels, or a single barrier along one side of, provided that the tracks 6 serve to generally prevent the rolling platform 4 from veering substantially side-to-side as the rolling platform 4 translates lengthwise along the disposal barge 2. The primary objective of the wheel tracks 6 is to provide a means for preventing the plant 5 from dropping into the lengthwise opening 3A during movement of the rolling platform 4 and plant 5. In a preferred embodiment, movement of the rolling platform 4 and plant 5 toward the bow or stern is automated by being drawn by either a bow-mounted winch 7, in connection with the rolling platform 4 via a steel cable 8 or a stern-mounted winch 9 and steel cable 10, respectively.

The cleaning and maintenance plant 5 consists of three sub-components: (1) a vacuum system for evacuating residual solid (e.g., coal) and solid water slurries from the holds 11 of "dirty" hopper-type cargo barges 12 for collection in the vessel hold 2, (2) a pressurized water system for pressure washing the holds 11 of hopper cargo barges 12 and also driving water -driven siphon pumps used for evacuating density solid particulate from the holds of cargo barges 12, and (3) a plurality of barge repair equipment including portable welding equipment.

The vacuum system is comprised of a diesel or electrically-powered vacuum pump 13 mounted on the reinforced roller cover 4. The vacuum pump 13 draws solid or solid/water slurries 14 from the hold 11 of a hopper barge 12 through a vacuum hose 15, discharging the solid (or solid/water) material 14 through discharge conduit 16 directed into the vessel hold 3. In a preferred embodiment, the vacuum pump 13 has multiple suction ports 17 and hoses 15 capable of cleaning multiple hopper barges 12 aligned, as exemplified in FIG. 3, immediately adjacent to the cleaning vessel 2. In a preferred embodiment, the vacuum hose 15 is designed with sufficient: (1) inner diameter, e.g., 8–12, to vacuum large solid particulate (e.g., coal), (2) flexibility through pleated or smooth flexible rubber or plastic construction to facilitate operator handling, and (3) length, in order reach the holds 11 of adjacent hopper barges 12. In a preferred method of operation, the collected solid material 14 will be evenly distributed within the vessel hold 3 by moving the roller cover-mounted cleaning plant along the length of the vessel as the recovered solids are being cleaned from adjacent barges. Water 18 collected during the vacuum cleaning of solid/water slurries can be removed from the hold 3 by an immersion pump 19 installed in the vessel hold 3 thus extending the capacity of the hold and the duration the apparatus 1 can be operated without interruption before having to offload the substantially solid recovered material. In a preferred embodiment, immersion pumps 19 are placed in the four corners of the vessel hold 3 and, after allowing sufficient time for solid/water separation, water is pumped out of the hold and discharged through discharge conduits 20 into the river or waterway 21.

The pressurized water system consists of a single or multiplicity of diesel or electrically-driven pumps 22 which are designed to draw water from the waterway 21 that the vessel 2 resides in, and discharge pressurized water to a multiple port manifold 23 for distribution to a multiplicity of attached hoses 24 (FIG. 2). Each water hose 24 can be used for (1) pressure washing the holds 11 of adjacent hopper barges 12 or (2) supplying water-driven siphon-type pumps 25 which can be used to evacuate residual, solid particulate (e.g., environmentally acceptable materials such as grains) grains) from barge holds.

Figures 4A, 4B:
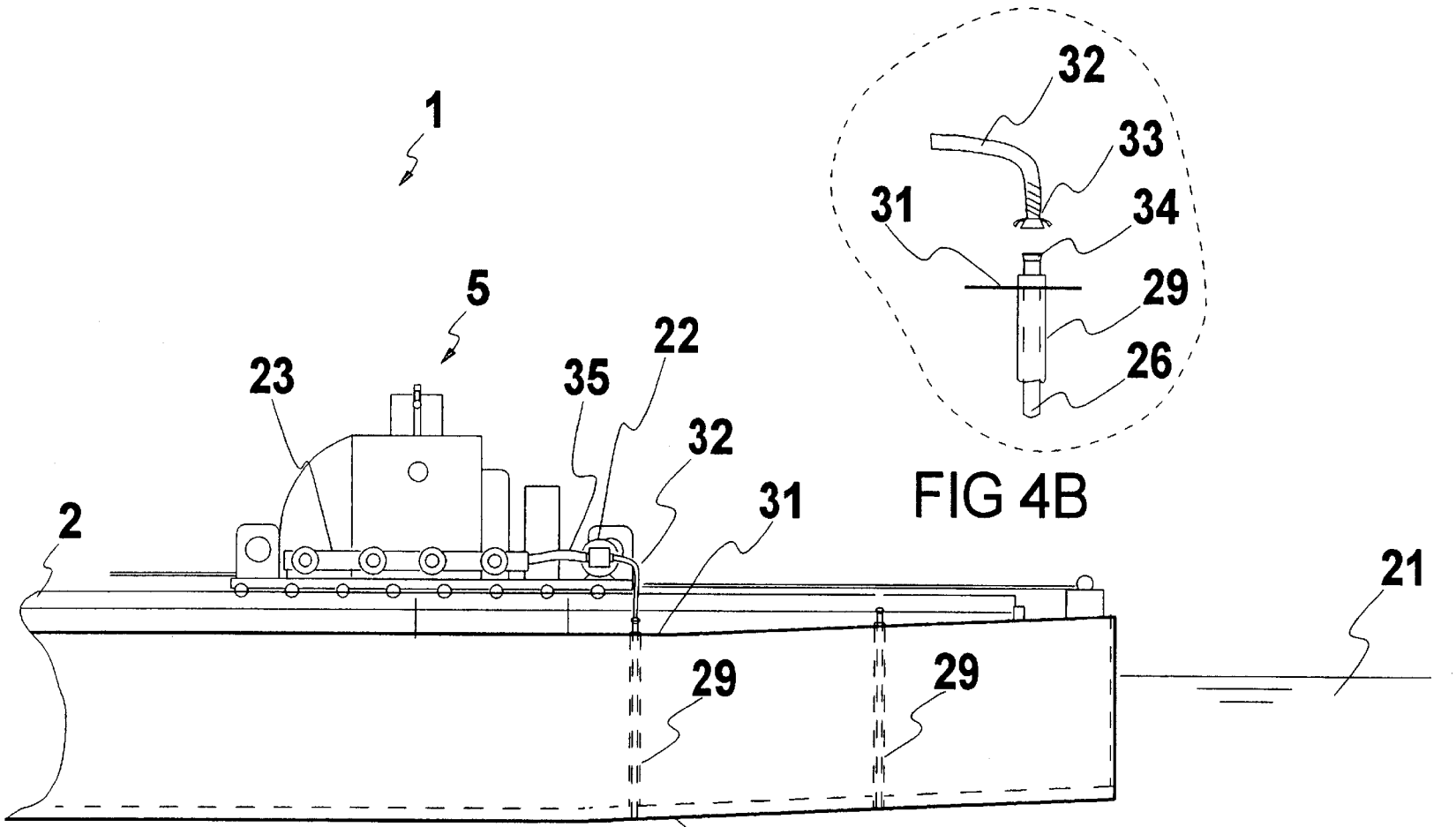
FIG. 4A describes a preferred embodiment of the deck-level "quick-connect" connection of the water suction conduit for the cleaning plant.
FIG. 4B is a cross-sectional view of a preferred embodiment of the present invention describing the barge, immersion pump for water discharge and "quick-connect" assembly.
Figure 5:
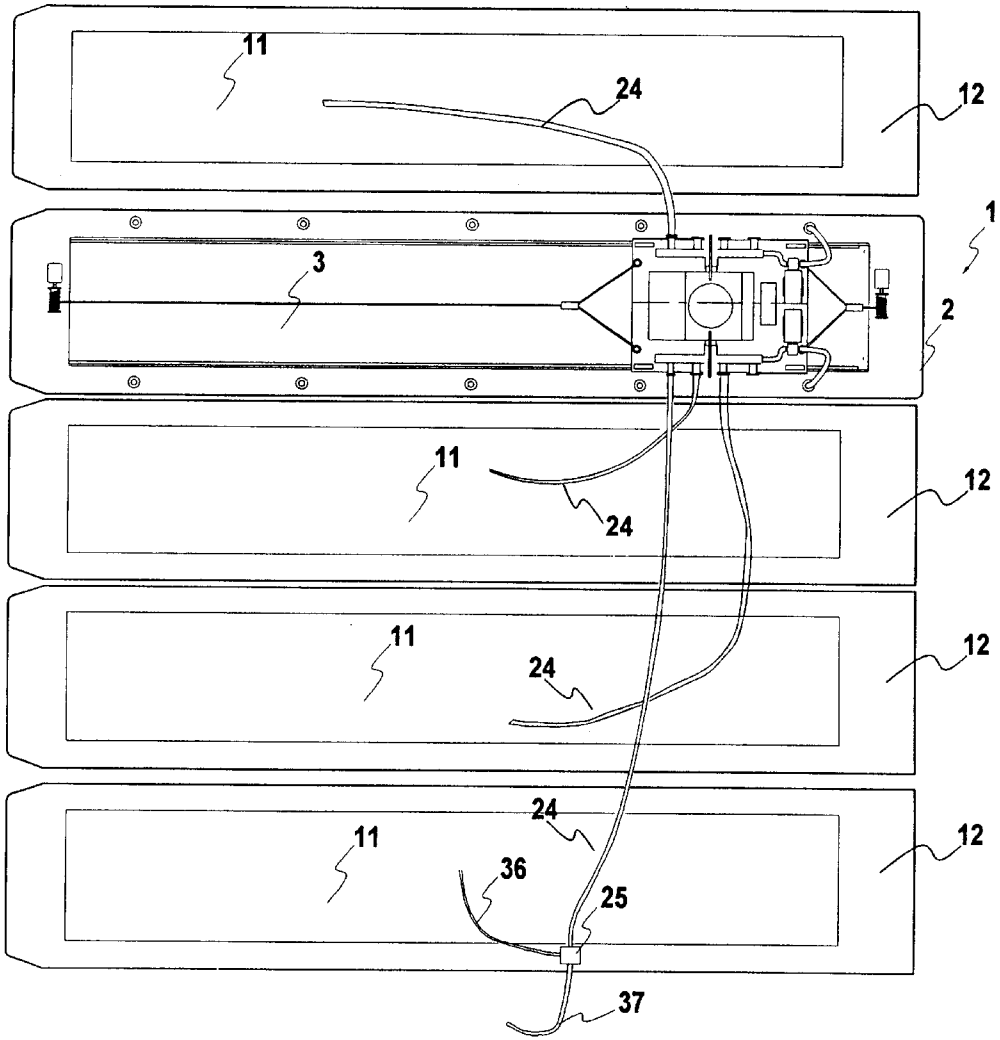
FIG. 5 is a plan view of a preferred embodiment of the present invention describing the barge cleaning vessel and plant, and a "parallel" orientation of the cargo barges being cleaned.

Turning to FIGS. 4A, 4B and 5, and referring back to FIG. 1, the pressurized water system of the present invention utilizes the surrounding waterway 21 as its source of water. Water is drawn though vertical risers 26 inserted through the port 27 and starboard 28 wing tanks of the vessel 2. The riser pipes 26 are inserted through collar pipes 29 which penetrate the hull 30 and deck surface 31 of the wing tanks 27, 28. In order to reduce pressure losses at the suction of the pump 21, the riser 26/collar pipe 29 assembly is installed at multiple, equally spaced locations along the port 27 and starboard 28 wing tanks. As the plant 5 is moved along the vessel 2, the pump can draw water from the nearest riser pipe 26 by quick connection of the pump suction hose 32 to the riser pipe 26 through couplings 33, 34. The pump 21 discharges pressurized water through a discharge pipe 35 to the manifold 23 where it is distributed among a plurality of connected hoses 24.

In a preferred embodiment the suction hose 32 and riser pipe 26 arc 3" to 5" diameter flexible rubber or plastic (PVC) hose or pipe, respectively.

In a preferred embodiment, the collar pipe 28 is a 4" to 6" diameter steel pipe welded in place in the wing tanks 27, 28.

In a preferred embodiment of the present invention, the cleaning plant consists of two water pumps 22 located on the port and starboard sides of the plant.

In a preferred embodiment, the water pump 22 is a diesel or electrically powered positive displacement, or other self-priming pump.

In a preferred embodiment the pressurized water hoses 24 range in diameter from 2 to 4"in diameter and are fabricated from reinforced flexible rubber or plastic.

Referring to FIG. 5, the pressurized water system of the present invention is used to supply siphon-type suction pumps 25 through connection to the pressurized water hoses 24. The flexibility and light weight of the hoses 24 siphon pump 25 enables operators to easily move it from barge to barge. In this method, the siphon suction hose 36 is inserted into the hold 11 of the hopper barges to evacuate residual particulate solids (e.g., grain) and discharge it through the siphon pump discharge hose 37. While the stationary vacuum method 13 is ideally suited to cleaning hopper barges 12 immediately adjacent to the cleaning vessel 2, such as coal barges, the water-driven siphon method can be used to service barges assembled a longer distance from the plant as would be the case when servicing a group of barges assembled in parallel with the cleaning vessel 2 (the parallel arrangement is shown in FIG. 5). Thus, an advantage of the water-driven siphon vacuum system is its ability to project a vacuum source a significantly greater distance from the cleaning vessel than the fixed vacuum system, thus expanding the plant's effective operating range significantly.

In a preferred embodiment, the siphon pump 25 is a Gorman Rupp or equivalent water driven siphon pump.

Referring back to FIGS. 1, 2 and 3 a preferred embodiment of the present invention includes diesel storage capacity 38 in the cleaning and utility plant to fuel the diesel-powered motors that drive the vacuum 13 and pumps 22. An alternative embodiment substitutes the diesel motors with electric motors which are powered by a diesel powered generator.

The cleaning and utility plant 5 of the present invention also includes portable welding equipment 39 that can be used to make minor repairs of the hopper barges during, or independent, of the cleaning process.

The roller cover 4 and attached cleaning and utility plant 5 described in the present invention is designed to be crane lifted for removal. Pad eyes 40 are welded at the four corners of the roller cover 4 to enable cable connection.

The versatility and mobility of the described river barge cleaning apparatus 1 is provided by its ability to be navigated among an array of "dirty" hopper barges 12 to clean them on location while minimizing time consuming re-alignment of the vessels. In a typical embodiment of the present invention (FIGS. 5 and 6) the cleaning vessel 2 is inserted among several grain barges 12 and the pressurized water hoses 24 and/or siphon pumps 25 are used to clean the adjacent "dirty" barges. In another embodiment of the present invention (FIG. 3) the cleaning vessel 2 can be inserted between, and clean two hopper barges containing large size solid particulate (e.g., coal) by vacuum evacuation. In this method, pressurized water, introduced by the pressurized water hoses 24, is used to collect and slurry the solids, which are vacuumed into the hold 3 of the cleaning vessel 2 through the vacuum hoses 15 installed in each hold 11 of the adjacent barges 12.

Figure 6:
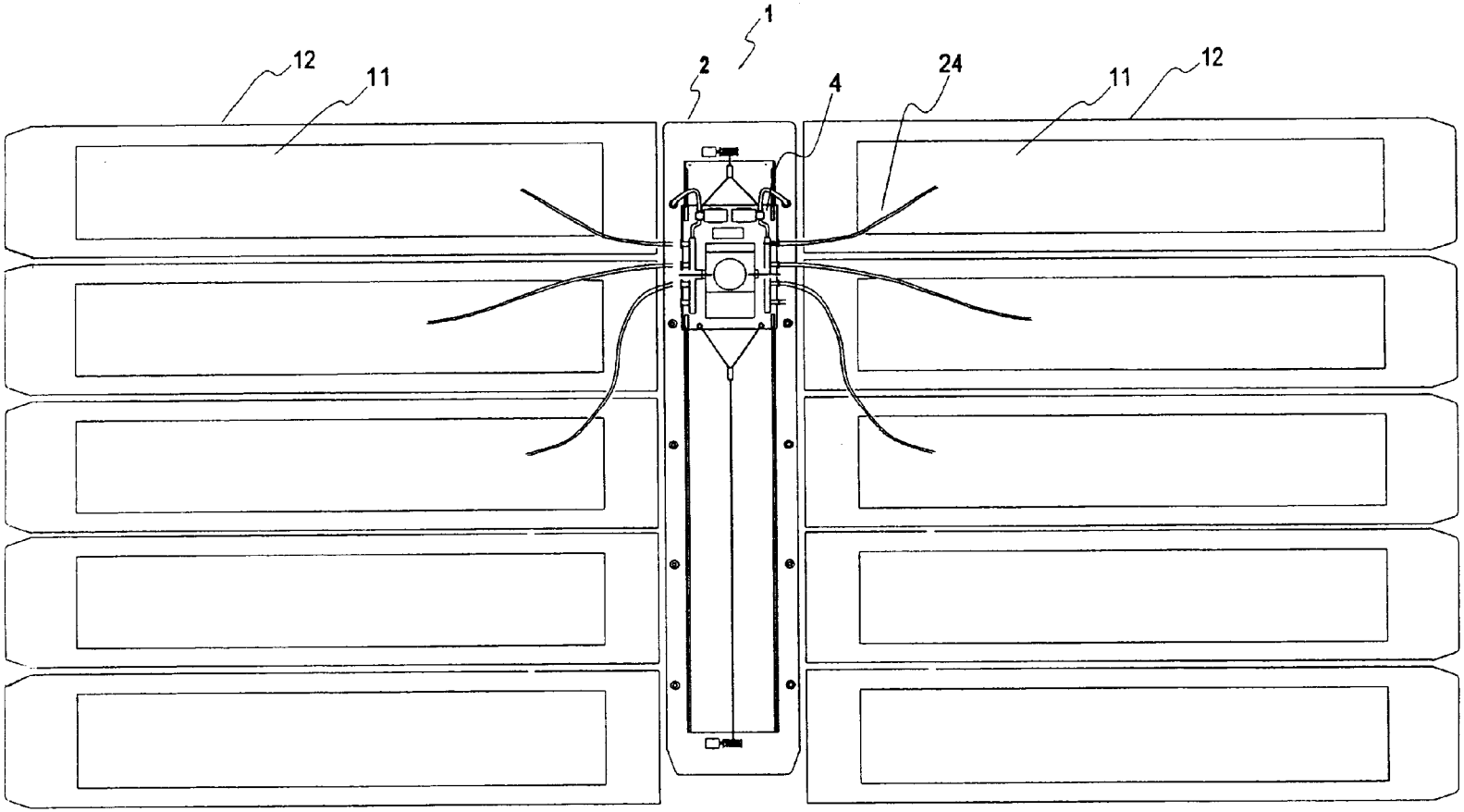
FIG. 6 is a plan view of a preferred embodiment of the present invention describing the barge cleaning vessel and plant, and a "perpendicular" orientation of the cargo barges being cleaned.

FIG. 5 shows a disposal hopper barge 2 in a "parallel" orientation relative to the cargo barges being cleaned 12. FIG. 6 shows a disposal hopper barge 2 in a "perpendicular" orientation relative to the cargo barges being cleaned 12.

Figure 7:
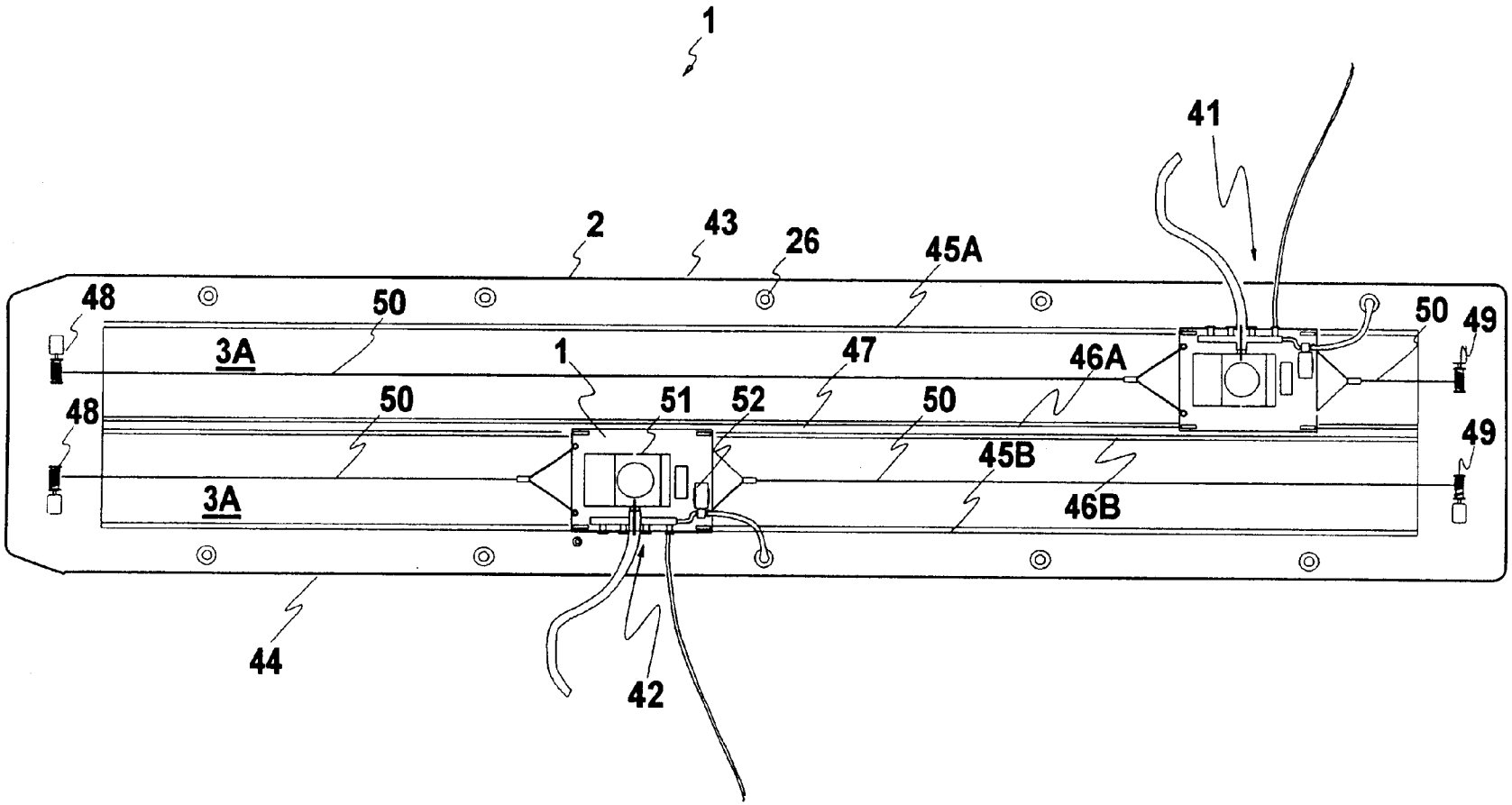
FIG. 7 is a plan view of a preferred embodiment of the invention showing two plants situated side-by-side.

Turning finally to FIG. 7, the plant 5 described previously can be sub-divided into two smaller plants, port plant 41 and starboard plant 42, that operate independently on the port 43 and starboard 44 sides of the vessel 2. With a means similar to the previous embodiments, each plant 41, 42 translates along an outside track 45A, 45B and center track 46A, 46B. The center tracks 46A, 46B are mounted on a center support plate 47. The center support plate 47 extends between fore and aft edges of the lengthwise opening 3A. Wheel tracks 45Aand 46A form a pair of port wheel tracks, with track 45A extending substantially along a port edge of the lengthwise opening 3A, and track 46A extending substantially along a port edge of the central support plate. Similarly, wheel tracks 45Band 46B form a pair of starboard wheel tracks, with track 45B extending substantially along a starboard edge of the lengthwise opening 3A, and track 46B extending substantially along a starboard edge of the central support plate. The tracks can be configured in the manner described above. In a means similar to previous embodiments, the motion of each plant can be automated through action of bow 48 and stern 49 winches and cables 50. Each plant 41 and 42 is comprised of the same equipment contained in the previous embodiments of this invention (e.g, vacuum pump 51, water pump 52, manifold 53). Each of the port 41 and starboard 42 plants can be provided with the cleaning and maintenance equipment described above.

In operation, the cleaning plant of the invention is used by installing the cleaning plant on a rolling platform 4 on a disposal hopper barge 2 such that translation of the rolling platform 4 along the lengthwise opening 3A of the disposal hopper barge 2 permits the plant to be selectively positioned along the lengthwise opening 3A. The disposal hopper barge 2 is then positioned among an array of the dirty hopper barges 12, and the cleaning plant is used to clean the holds of the dirty hopper barges. The cleaning plant is moved along the disposal hopper barge as needed to thereby maximize use of the hold of the disposal hopper barge for disposal of waste. FIG. 5 shows a typical arrangement of dirty hopper barges. In the array of FIG. 5, the disposal hopper barge 2 may be positioned within the array such that the dirty hopper barges 12 are substantially parallel to the disposal hopper barge. FIG. 6 shows another typical arrangement of dirty hopper barges. In the array of FIG. 6, the disposal hopper barge 2 may be positioned within the array such that the dirty hopper barges 12 are substantially perpendicular to the disposal hopper barge. In the arrangements shown in FIGS. 5 and 6, the cleaning plant 5 may be used to efficiently clean dirty hopper barges 12 on either side of the disposal hopper barge 2. The siphon pump arrangement 24–25 is particularly effective in the parallel and perpendicular arrangements shown in FIGS. 5 and 6, because the siphon type pumps 25 can be readily moved from barge to barge 12 while providing suction up to twelve dirty barges 12 away from the disposal hopper barge 2. By use of the foregoing methods, movement and maneuvering of dirty hopper barges 12 can be essentially eliminated.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An apparatus for cleaning holds of dirty hopper barges, said apparatus configured for use on a disposal hopper barge floating on a water body, a deck of said disposal hopper barge having a substantially lengthwise opening communicating with a hold of said disposal hopper barge, comprising:

a rolling platform mounted over said lengthwise opening and translatable fore and aft along said lengthwise opening, and a cleaning plant mounted on said rolling platform such that translation of said rolling platform along said lengthwise opening permits said cleaning plant to be selectively positioned along said lengthwise opening.

2. The apparatus of claim 1, further comprising a bow winch mounted substantially on a bow of said disposal barge, a cable of said bow winch connected to said rolling platform or said plant, and a stern winch mounted substantially on a stern of said disposal barge, a cable of said stem winch connected to said rolling platform or said plant, selective operation of said bow and stern winches facilitating translation and positioning of said plant along said lengthwise opening as needed during cleaning of said dirty hopper barges.

3. The apparatus of claim 2, further comprising a vacuum system on said cleaning plant, said vacuum system comprising:

a vacuum pump mounted on said rolling platform, said vacuum pump having one or more suction ports, one or more vacuum hoses, each of said vacuum hoses connected to one of said suction ports such that waste from said dirty hopper barges may be drawn through said one or more vacuum hoses to said suction ports via operation of said vacuum pump, and a discharge conduit communicating with said one or more suction ports, said discharge conduit configured to receive said vacuumed waste from said one or more vacuum hoses and discharge said vacuumed waste into said hold of said disposal hopper barge.

4. The apparatus of claim 3, further comprising a pressurized water system on said cleaning plant, said pressurized water system comprising:

a water intake conduit, an intake end of said water intake conduit fluidly communicating with a water source, at least one water hose fluidly connected to said water intake conduit via a pipe assembly, and a pump means operably connected to said pipe assembly such that operation of said pump draws water from said water source through said water intake conduit and expels said water through said water hose under sufficient pressure to facilitate cleaning of said holds of said dirty hopper barges.

5. The apparatus of claim 1, further comprising a vacuum system means on said cleaning plant for use in vacuum transfer of waste from said holds of said dirty hopper barges to said hold of said disposal hopper barge.

6. The apparatus of claim 1, further comprising a vacuum system on said cleaning plant, said vacuum system comprising:

a vacuum pump mounted on said rolling platform, said vacuum pump having one or more suction ports, one or more vacuum hoses, each of said vacuum hoses connected to one of said suction ports such that waste from said dirty hopper barges may be drawn through said one or more vacuum hoses to said suction ports via operation of said vacuum pump, and a discharge conduit communicating with said one or more suction ports, said discharge conduit configured to receive said vacuumed waste from said one or more vacuum hoses and discharge said vacuumed waste into said hold of said disposal hopper barge.

7. The apparatus of claim 6, further comprising at least one immersion pump mounted in said hold of said disposal hopper barge, each said immersion pump communicating with said water body via a water outlet conduit, whereby operation of each said immersion pump permits water that has separated from collected waste to be returned to said water body via said water outlet conduit, thereby maximizing use of said hold of said disposal hopper barge for waste collection.

8. The apparatus of claim 7, further comprising an inlet filter on each said immersion pump, said inlet filter filtering out impurities from water drawn through said outlet conduit to thereby purify water returned to said water body to an environmentally acceptable purity.

9. The apparatus of claim 1, further comprising a pressurized water system means on said cleaning plant for washing down said holds of said dirty hopper barges.

10. The apparatus of claim 1, further comprising a pressurized water system on said cleaning plant, said pressurized water system comprising:

a water intake conduit, an intake end of said water intake conduit fluidly communicating with a water source, at least one water hose fluidly connected to said water intake conduit via a pipe assembly, and a pump means operably connected to said pipe assembly such that operation of said pump draws water from said water source through said water intake conduit and expels said water through said water hose under sufficient pressure to facilitate cleaning of said holds of said dirty hopper barges.

11. The apparatus of claim 10, wherein said water source is said water body.

12. The apparatus of claim 10, wherein said pipe assembly further comprises a pump suction hose, an intake end of said pump suction hose removably coupled to an output end of said water intake conduit, an output end of said pump suction hose attached to an input end of a discharge pipe via said pump means, an output end of said discharge pipe attached to an intake of a manifold, said manifold having multiple outlet ports, and each of said water hoses attached to one of said manifold outlet ports to thereby permit water drawn through said water intake conduit to be simultaneously expelled through a plurality of said water hoses.

13. The apparatus of claim 12, wherein said disposal hopper barge is provided with a plurality of said water intake conduits, each said water intake conduit being disposed substantially vertically through either a port or starboard wing tank of said disposal hopper barge, said intake ends of said water intake conduits fluidly communicating with said water body to thereby provide said water source, said water intake conduits spaced along said port and starboard wing tanks so as to provide said cleaning plant with convenient access to a nearby one of said water intake conduits as said cleaning plant is selectively moved fore and aft along said disposal hopper barge.

14. The apparatus of claim 10, further comprising one or more siphon-type vacuum pumps on said water hoses, a siphon suction hose and a siphon pump discharge hose operably attached to each said siphon-type vacuum pump, each said siphon-type pump being operable by said pressurized water in said water hose to thereby vacuum waste into said siphon suction hose and discharge said vacuumed waste through said siphon pump discharge hose.

15. The apparatus of claim 1, further comprising a set of maintenance tools and equipment, including welding supplies, on said cleaning plant.

16. The apparatus of claim 1, further comprising a set of maintenance tools and equipment, including welding supplies, on said deck of said disposal hopper barge.

17. An apparatus for cleaning holds of dirty hopper barges, said apparatus configured for use on a disposal hopper barge floating on a water body, a deck of said disposal hopper barge having a substantially lengthwise opening communicating with a hold of said disposal hopper barge, comprising:

a center support plate extending between fore and aft edges of said lengthwise opening, a pair of port wheel tracks, one of said port wheel tracks extending substantially along a port edge of said lengthwise opening, said other port wheel track extending substantially along a port edge of said center support plate, a pair of starboard wheel tracks, one of said starboard wheel tracks extending substantially along a starboard edge of said lengthwise opening, said other starboard wheel track extending substantially along a starboard edge of said center support plate, a port rolling platform mounted on said pair of port wheel tracks such that said port rolling platform is translatable fore and aft along said lengthwise opening, a port cleaning plant mounted on said port rolling platform such that translation of said rolling platform along said lengthwise opening permits said port cleaning plant to be selectively positioned along said lengthwise opening, a starboard rolling platform mounted on said pair of starboard wheel tracks such that said starboard rolling platform is translatable fore and aft along said lengthwise opening, and a starboard cleaning plant mounted on said starboard rolling platform such that translation of said rolling platform along said lengthwise opening permits said starboard cleaning plant to be selectively positioned along said lengthwise opening.

18. The apparatus of claim 17, further comprising, a first bow winch mounted substantially on a port-side bow of said disposal barge, a cable of said first bow winch connected to said port rolling platform or said port plant, a second bow winch mounted substantially on a starboard-side bow of said disposal barge, a cable of said second bow winch connected to said starboard rolling platform or said starboard plant, a first stern winch mounted substantially on a port-side stem of said disposal barge, a cable of said first stern winch connected to said port rolling platform or said port plant, a second stem winch mounted substantially on a starboard-side stern of said disposal barge, a cable of second said stern winch connected to said starboard rolling platform or said starboard plant, selective operation of said bow and stem winches facilitating translation and positioning of said port and starboard plants along said lengthwise opening as needed during cleaning of said dirty hopper barges.

19. The apparatus of claim 18, further comprising a vacuum system on each of said cleaning plants, each said vacuum system comprising:

a vacuum pump mounted on said rolling platform, said vacuum pump having one or more suction ports, one or more vacuum hoses, each of said vacuum hoses connected to one of said suction ports such that waste from said dirty hopper barges may be drawn through said one or more vacuum hoses to said suction ports via operation of said vacuum pump, and a discharge conduit communicating with said one or more suction ports, said discharge conduit configured to receive said vacuumed waste from said one or more vacuum hoses and discharge said vacuumed waste into said hold of said disposal hopper barge.

20. The apparatus of claim 19, further comprising a pressurized water system on each of said cleaning plants, each said pressurized water system comprising:

a water intake conduit, an intake end of said water intake conduit fluidly communicating with a water source, at least one water hose fluidly connected to said water intake conduit via a pipe assembly, and a pump means operably connected to said pipe assembly such that operation of said pump draws water from said water source through said water intake conduit and expels said water through said water hose under sufficient pressure to facilitate cleaning of said holds of said dirty hopper barges.

21. The apparatus of claim 17, further comprising a vacuum system means on at least one of said cleaning plants for use in vacuum transfer of waste from said holds of said dirty hopper barges to said hold of said disposal hopper barge.

22. The apparatus of claim 17, further comprising a vacuum system on at least one of said cleaning plants, said vacuum system comprising:

a vacuum pump mounted on said rolling platform, said vacuum pump having one or more suction ports, one or more vacuum hoses, each of said vacuum hoses connected to one of said suction ports such that waste from said dirty hopper barges may be drawn through said one or more vacuum hoses to said suction ports via operation of said vacuum pump, and a discharge conduit communicating with said one or more suction ports, said discharge conduit configured to receive said vacuumed waste from said one or more vacuum hoses and discharge said vacuumed waste into said hold of said disposal hopper barge.

23. The apparatus of claim 22, further comprising at least one immersion pump mounted in said hold of said disposal hopper barge, each said immersion pump communicating with said water body via a water outlet conduit, whereby operation of each said immersion pump permits water that has separated from collected waste to be returned to said water body via said water outlet conduit, thereby maximizing use of said hold of said disposal hopper barge for waste collection.

24. The apparatus of claim 23, further comprising an inlet filter on each said immersion pump, said inlet filter filtering out impurities from water drawn through said outlet conduit to thereby purify water returned to said water body to an environmentally acceptable purity.

25. The apparatus of claim 17, further comprising a pressurized water system means on at least one of said cleaning plants for washing down said holds of said dirty hopper barges.

26. The apparatus of claim 17, further comprising a pressurized water system on at least one of said cleaning plants, said pressurized water system comprising:

a water intake conduit, an intake end of said water intake conduit fluidly communicating with a water source, at least one water hose fluidly connected to said water intake conduit via a pipe assembly, and a pump means operably connected to said pipe assembly such that operation of said pump draws water from said water source through said water intake conduit and expels said water through said water hose under sufficient pressure to facilitate cleaning of said holds of said dirty hopper barges.

27. The apparatus of claim 26, wherein said water source is said water body.

28. The apparatus of claim 26, wherein said pipe assembly further comprises a pump suction hose, an intake end of said pump suction hose removably coupled to an output end of said water intake conduit, an output end of said pump suction hose attached to an input end of a discharge pipe via said pump means, an output end of said discharge pipe attached to an intake of a manifold, said manifold having multiple outlet ports, and each of said water hoses attached to one of said manifold outlet ports to thereby permit water drawn through said water intake conduit to be simultaneously expelled through a plurality of said water hoses.

29. The apparatus of claim 28, wherein said disposal hopper barge is provided with a plurality of said water intake conduits, each said water intake conduit being disposed substantially vertically through either a port or starboard wing tank of said disposal hopper barge, said intake ends of said water intake conduits fluidly communicating with said water body to thereby provide said water source, said water intake conduits spaced along said port and starboard wing tanks so as to provide said cleaning plants with convenient access to a nearby one of said water intake conduits as said cleaning plant is selectively moved fore and aft along said disposal hopper barge.

30. The apparatus of claim 28, further comprising one or more siphon-type vacuum pumps on said water hoses, a siphon suction hose and a siphon pump discharge hose operably attached to each said siphon-type vacuum pump, each said siphon-type pump being operable by said pressurized water in said water hose to thereby vacuum waste into said siphon suction hose and discharge said vacuumed waste through said siphon pump discharge hose.

31. The apparatus of claim 17, further comprising a set of maintenance tools and equipment, including welding supplies, on at least one of said cleaning plants.

32. The apparatus of claim 17, further comprising a set of maintenance tools and equipment, including welding supplies, on said deck of said disposal hopper barge.

33. A method of cleaning holds of an array of dirty hopper barges floating on a water body comprising:

providing a disposal hopper barge, said disposal hopper barge having a substantially lengthwise opening communicating with a hold of said disposal hopper barge and a rolling platform mounted over and translatable fore and aft along said lengthwise opening, installing a cleaning plant on said rolling platform such that translation of said rolling platform along said lengthwise opening permits said plant to be selectively positioned along said lengthwise opening, positioning said disposal hopper barge among said array of dirty hopper barges, and utilizing said cleaning plant to clean said holds of said dirty hopper barges.

34. The method of claim 33, wherein said step of utilizing said cleaning plant further includes moving said cleaning plant along said disposal hopper barge as needed to thereby maximize use of said hold of said disposal hopper barge for disposal of waste.

35. The method of claim 33, wherein said dirty hopper barges are positioned substantially parallel to said disposal hopper barge.

36. The method of claim 33, wherein said dirty hopper barges are positioned substantially perpendicular to said disposal hopper barge.

* * * * *